US005291828A

United States Patent [19]

Nerheim et al.

[11] Patent Number: 5,291,828

[45] Date of Patent: Mar. 8, 1994

[54] INSENSITIVE PROPELLANT IGNITOR

[75] Inventors: Eldon Nerheim, Edina; Peter R. Kalkbrenner, Eden Prairie; Todd P. Goblish, Maple Grove, all of Minn.

[73] Assignee: Alliant Techsystems, Inc., Edina, Minn.

[21] Appl. No.: 970,993

[22] Filed: Oct. 26, 1992

Related U.S. Application Data

[63] Continuation of Ser. No. 745,936, Aug. 16, 1991, abandoned.

[51] Int. Cl.[5] ..... F42C 19/12

[52] U.S. Cl. ..... 102/202; 102/202.7; 60/39.823

[58] Field of Search ..... 102/202.7, 202.5, 202, 102/202.14, 204, 202.8, 202.9; 60/39.821, 39.823

[56] References Cited

U.S. PATENT DOCUMENTS

| | | | |
|---|---|---|---|
| 3,978,791 | 9/1976 | Lemley et al. . | |
| 4,027,592 | 6/1977 | Hubsch et al. | 102/202 |
| 4,068,591 | 1/1978 | Betts | 60/256 |
| 4,195,550 | 4/1980 | Witt et al. | 102/204 |
| 4,464,989 | 8/1984 | Gibson et al. | 102/202 |
| 4,602,565 | 7/1986 | MacDonald et al. | 102/202.7 |
| 4,671,177 | 6/1987 | Mayville | 102/204 |
| 4,735,145 | 4/1988 | Johnson et al. | 102/202.5 |
| 4,762,067 | 8/1988 | Barker et al. | 102/202.14 |
| 4,770,099 | 9/1988 | Brede et al. | 102/202.5 |
| 4,831,932 | 5/1989 | Bayerkohler et al. | 102/202.5 |
| 4,856,433 | 8/1989 | Evans | 102/204 |
| 4,862,803 | 9/1989 | Nerheim et al. | 102/202.5 |
| 4,930,418 | 6/1990 | Folsom | 102/201 |
| 4,998,477 | 3/1991 | Barker | 102/202.5 |

FOREIGN PATENT DOCUMENTS

| | | | |
|---|---|---|---|
| 0428074 | 5/1991 | European Pat. Off. . | |
| 3340617 | 5/1985 | Fed. Rep. of Germany . | |
| 4001864 | 8/1990 | Fed. Rep. of Germany . | |
| 984034 | 7/1951 | France | 102/202.5 |
| WO89/12211 | 12/1989 | PCT Int'l Appl. . | |

OTHER PUBLICATIONS

"Exploding Foil Initiator (EFI), Technical Discussion", *Secondary Explosive Initiators & Accessories*, pp. 7-8, RISI, Jan. 1991.

*Primary Examiner*—Stephen M. Johnson

*Attorney, Agent, or Firm*—Merchant, Gould, Smith, Edell, Welter & Schmidt

[57] ABSTRACT

An insensitive pellet ignitor utilizes a slapper type detonator to initiate an insensitive explosive material. The insensitive explosive material is retained in a high strength housing which confines and dissipates the explosion. The insensitive explosive material is retained in a collar placed in a chamber having an orifice leading to propellant. The orifice does not allow the shockwave from the insensitive explosive to prematurely expel the propellant so that the propellant is ignited from the hot gases and particles resulting from the explosion which are ported through the orifice to the propellant.

9 Claims, 5 Drawing Sheets

INSENSITIVE PROPELLANT IGNITOR

This is a continuation, of application Ser. No. 07/745,936, filed Aug. 16, 1991, now abandoned.

BACKGROUND OF THE INVENTION

1. Field of the Invention

The present invention relates to an explosively insensitive ignitor apparatus and method for igniting a propellant.

2. Description of the Prior Art

Propellants have been ignited with primary explosives which are sensitive explosives, that is, a small amount of the primary explosive charge will easily detonate when subjected to a spark, flame, friction or a heated wire which will cause the explosive to reach its ignition temperature. The use of sensitive explosives in an ignitor causes several problems in that it is easily initiated by fires, heat, fragment impact and sympathetic detonation. This is a major safety concern particularly for military weapons.

Ignitors may also be of the two-stage variety wherein a primary explosive is used to ignite a secondary explosive which may then be used to ignite the propellant. The shockwave from the primary explosive and/or secondary explosive must be controlled so that the secondary explosive and the propellant itself are not expelled. Although the amount of primary sensitive explosive is reduced with this method, thereby reducing the resultant shockwave from an explosion of the sensitive explosive, this arrangement still has problems since there is ignition of the secondary insensitive explosive by a sensitive explosive. The safety problems are still present as the sensitive explosive could ignite from a slow cook off, fast cook off, sympathetic detonation, bullet impact, or fragment impact, thereby igniting the insensitive explosive.

Safety would be increased if the ignition of a propellant is accomplished using only insensitive explosives for detonation. However, problems arise when attempting to ignite the insensitive explosive and in confining and controlling the shockwave resulting therefrom. Insensitive explosives require a higher kinetic or thermal ignition energy, so that a typical bridge wire detonator may not have sufficient energy to cause the insensitive secondary explosive to detonate. In addition, if the resulting shockwave from the insensitive secondary explosive is too great, the propellant will be expelled without ignition as the shockwave passes through it. The energy from the shockwave must therefore be confined and dissipated to allow thermal or flame ignition of the propellant.

It can be seen then, that an initiator is required which does not utilize an explosively-sensitive material and which is ignited simply and safely. It can also be seen that an initiator is needed wherein the resulting shockwave from ignition of the insensitive secondary explosive is confined so that propellant is not expelled prematurely.

SUMMARY OF THE INVENTION

The present invention is directed to an insensitive propellant ignitor. According to the principles of the present invention, an explosive train for igniting a propellant is ignited with an explosively insensitive material by a slapper type detonator. The detonator is retained between a high strength steel housing and a cap which is bolted on over the slapper detonator. Within the housing proximate the slapper is an explosive chamber for retaining and initiating an insensitive secondary explosive material. When the slapper is energized, the current causes a flier portion to be expelled into the insensitive secondary explosive pellet, thereby causing ignition of the pellet. The shockwaves from the resulting explosion are confined and dissipated within the housing.

A small orifice in the secondary explosive chamber allows the hot gases and particles from the explosion of the secondary explosive to be controllably ported into a propellant. The flow of hot gases and hot particles is controlled by the orifice so that the propellant is not expelled and the strength of the housing and cap is such that the initiator housing is not blown apart. This provides for safe initiation of an explosive train so that propellant may be safely and efficiently ignited. The ignition of the propellant causes hot gas and particle generation which leads to expulsion forces that can be used to move or eject various mechanisms.

The present invention eliminates sensitive primary explosives from the ignitor explosive train. The present invention also overcomes the problems associated with confining the shockwave from the secondary explosive used in a propellant initiator.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding structure throughout the several views.

DETAILED DESCRIPTION OF THE PREFERRED EMBODIMENT(S)

Figure 1:
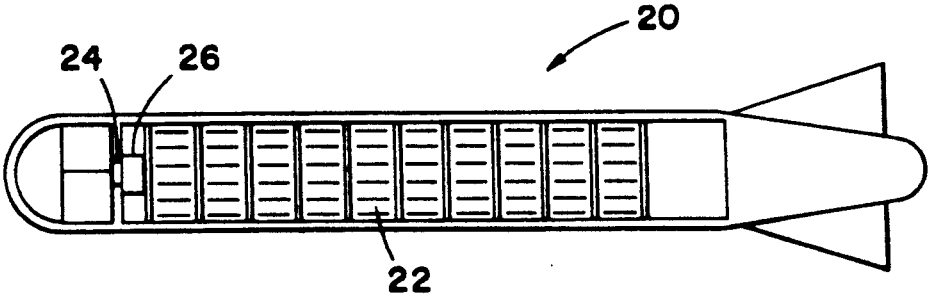
FIG. 1 shows a side sectional view of an airborne dispenser type vehicle utilizing an ignitor according to the principles of the present invention.

Referring now to the drawings, and referring in particular to FIG. 1, there is shown an airborne dispenser type vehicle 20. The dispenser 20 has a cargo container 22 which is propelled out the rear of the vehicle to disperse the cargo. A gas generator 26 is ignited by the initiator 24. The initiator 24 ignites material in the gas generator 26 to force the carrier 22 from the rear of the vehicle at high speeds.

Figure 2:
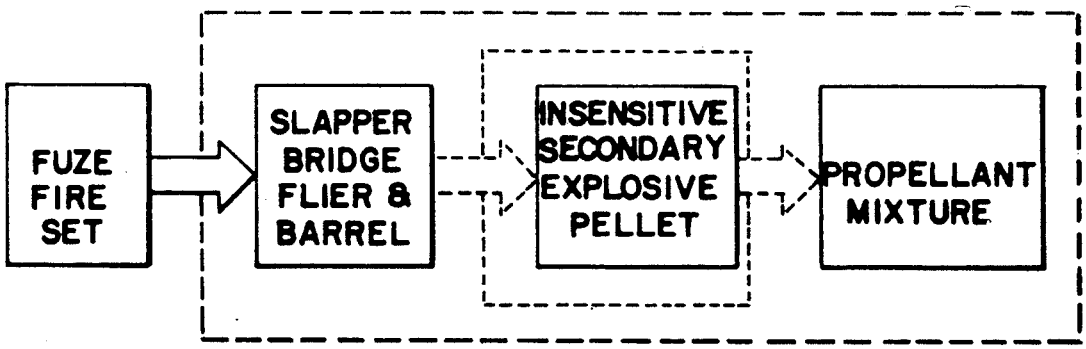
FIG. 2 shows a block diagram of the ignition sequence of the present invention.

In FIG. 2 there is shown the sequence for initiating propellant with the present invention. To begin the initiation, an electric current is passed through the slapper detonator. The energy from the current causes a portion of the flier of the slapper and the disk to be expelled into an insensitive explosive. The shockwave is confined and the hot gases and particles are ported to the propellant. The propellant is then ignited without being prematurely expelled.

Figure 3:
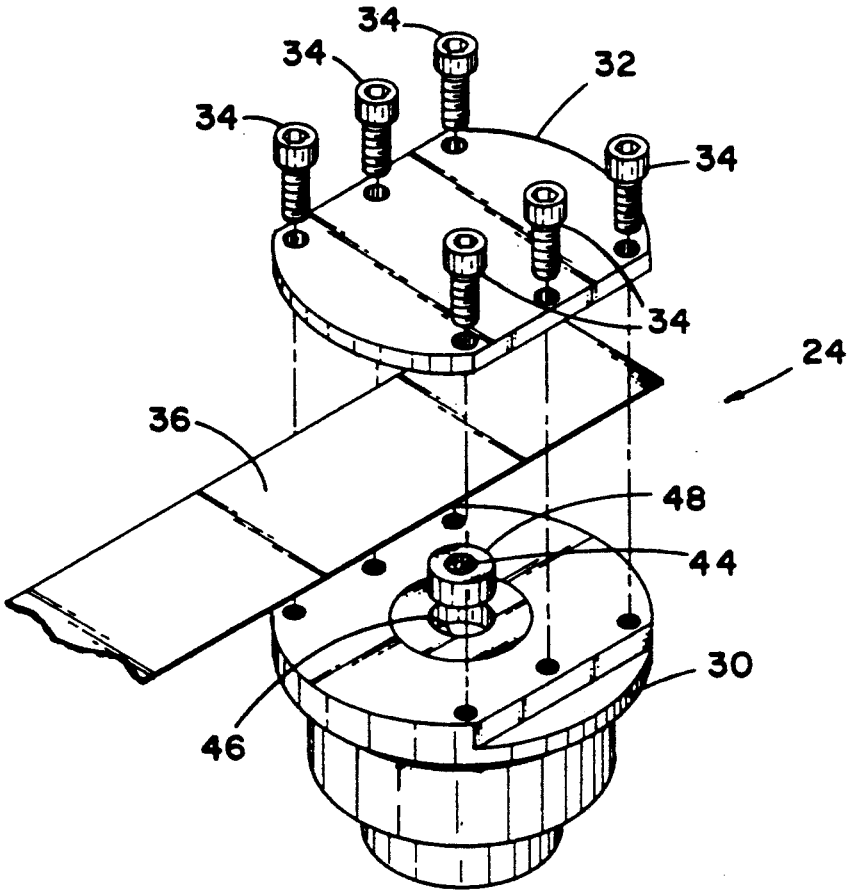
FIG. 3 shows an exploded perspective view of the ignitor shown in FIG. 1.

As shown in FIG. 3, the initiator 24 has a confinement housing 30 with a cap 32 held on by a number of bolts 34. Held between the cap 32 and the housing 30 is a slapper type detonator 36. The slapper 36 is adjacent an insensitive explosive pellet 44 which is retained in the housing 30 inside a protective steel collar 48. The housing 30, cap 32, and collar 48 are constructed with a high strength steel in the preferred embodiment to confine the initial explosion, as explained hereinafter. If the housing 30 and cover 32 do not withstand the explosion from the explosive 44, the flying debris may cause damage to the vehicle or nearby equipment or personnel.

Figure 4:
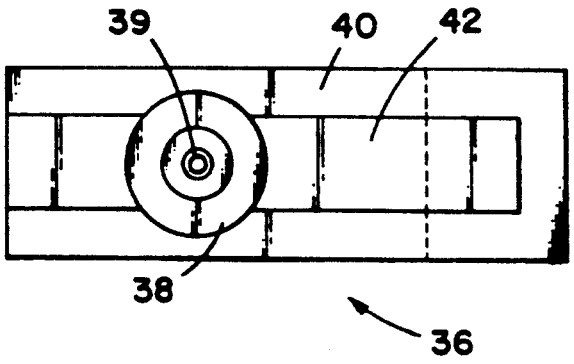
FIG. 4 shows a bottom plan view of a slapper type detonator.
Figure 9:
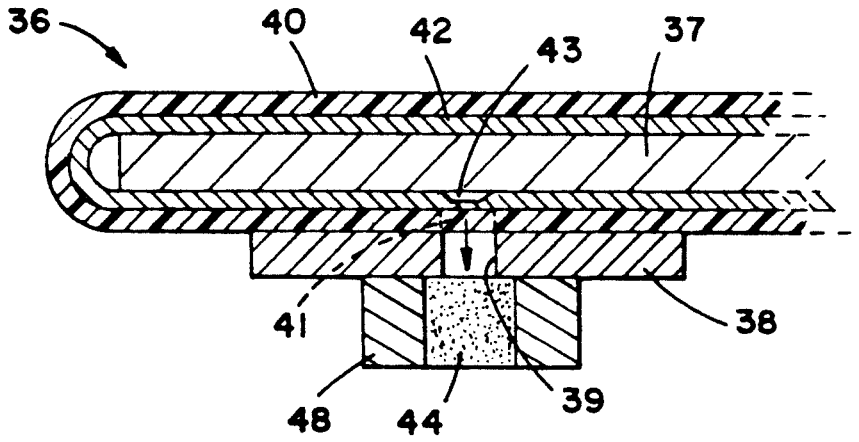
FIG. 9 shows a side view of the slapper detonator shown in FIG. 4.

As shown in FIGS. 4 and 9, the slapper detonator 36 has a base material 37 encapsulated in copper foil 42 and an outer insulating material 40. On the lower side of the slapper 36 is placed a disk 38 forming a barrel 39. The barrel 39 is placed intermediate a flier portion 41 of outer material 40 and the pellet 44, as shown in FIG. 9. The copper foil 42 carries an initiating current to a narrowed portion of the foil forming a bridge 43 for initiation, as explained hereinafter. The flier 41 and encapsulating material 40 are Kaptan in the preferred embodiment, although other materials which provide for insulating may be used.

Figure 5:
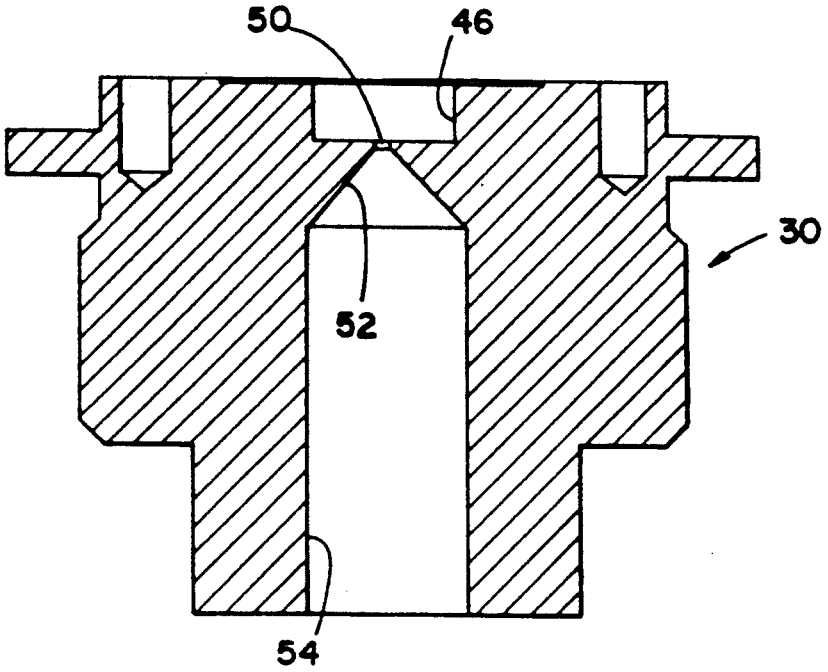
FIG. 5 shows a side view of the ignitor housing shown in FIG. 3.
Figure 6:
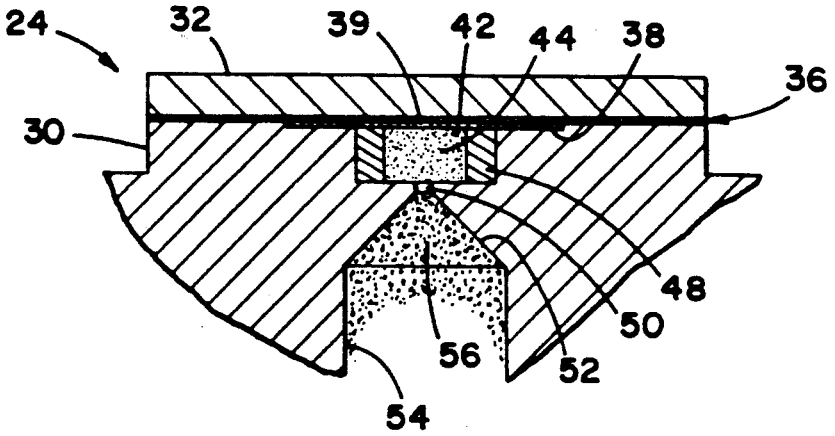
FIG. 6 shows a side view of the ignitor shown in FIG. 3 prior to ignition.

As shown in FIG. 5, the explosive pellet 44 is retained in the initiator housing 30 in an explosive chamber 46 at an upper end thereof with the steel collar 48 inserted in the chamber. In the preferred embodiment, the pellet 44 is HNS IV explosive, although it can be appreciated by those skilled in the art that other insensitive explosives may also be used. Below the explosive chamber 46 is an orifice 50 leading to a nozzle 52 opening to a propellant chamber 54 containing propellant 56. In the preferred embodiment, the propellant 56 is $BkNo_3$, however it can be appreciated that other types of propellant mixtures may be used. The orifice 50 and nozzle 52 confine the shockwave from the explosion of the explosive pellet 44 and control the passage of the hot gases and particles from that explosion to the propellant chamber 56. This is required as the shockwave could prematurely expel the propellant 56 before it is ignited. In the preferred embodiment, the nozzle 52 has a diameter of 0.050 inches to confine the hot gases, on the order of 4000° K., while the nozzle is tapered at approximately 45° to evenly distribute the hot gases.

Figure 7:
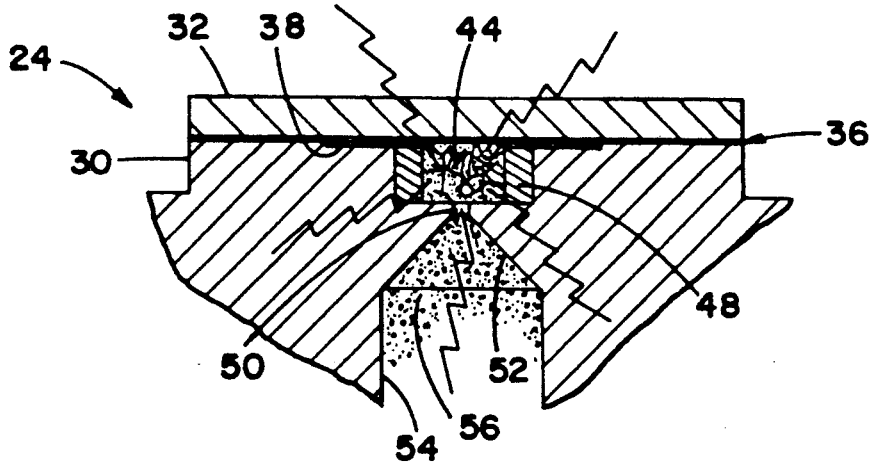
FIG. 7 shows a side view of the ignitor shown in FIG. 6 following initiation of the primary explosive.
Figure 8:
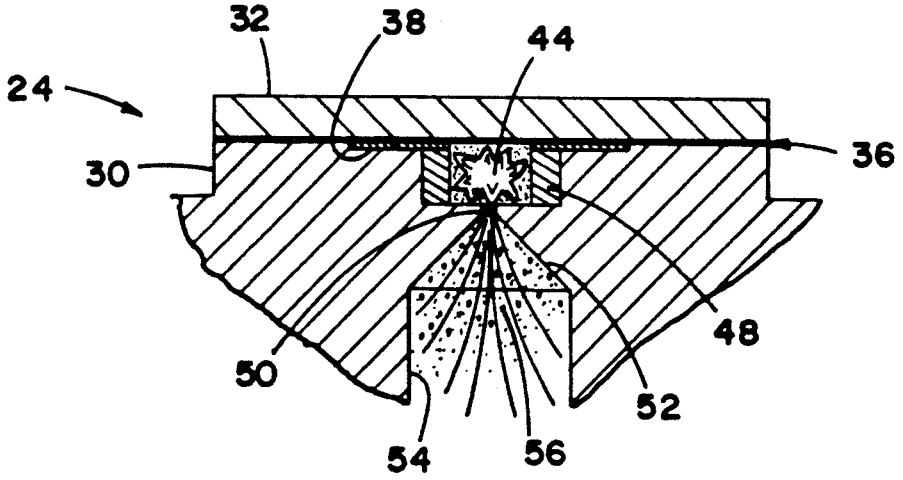
FIG. 8 shows a side view of the ignitor shown in FIG. 6 following ignition of the propellant.

To ignite the slapper 36, an initiating current on the order of 3000–5000 amps is delivered through the foil 42. This causes the bridge 43 shown in FIG. 9 to vaporize and sever, pushing the flier 41 through the barrel 39 against the pellet 44. The severed flier 41 strikes pellet 44 with a velocity of 300,000–500,000 cm/sec. The impact of the flier 41 into the pellet 44 ignites the pellet and initiates the explosive train. The explosion from ignition of the HNS IV pellet 44 is substantially confined within chamber 46. The force of the detonation sends shockwaves as shown in FIG. 7 throughout the initiator 24. The shockwave is confined and the energy is absorbed by the collar 48, the body of the housing 30, and the cap 32. In addition, the small orifice 50 prevents the propellant 56 from being blown out of the chamber 54. Only a slight portion of the hot gases and particles resulting from ignition of the pellet 44 escapes to the propellant 56 through the orifice 50. That small amount is distributed by the nozzle 52. The small amount that does escape is not enough to force the propellant 56 prematurely from the chamber 54. Therefore, after the shockwave passes, the thermal ignition of the propellant 56 from the pellet 44 is slower with less force through the orifice 50, as shown in FIG. 8. This provides for relatively preferred gradual hot gas and hot particle ignition.

It can be seen that with the initiator 24 absorbing much of the shock from ignition of the pellet 44, there is little danger of the detonation shockwave prematurely expelling the propellant 56. It can also be appreciated that the safety feature is improved since the pellet 44 may be an explosively insensitive material such as HNS IV. The rigid construction of the housing 30 and cap 32 adequately confines the explosion of the pellet 44 to eliminate hazards from the initial explosion. No bridge wires or explosively sensitive materials are required as had been previously done, thereby improving the reliability and safety of the ignitor.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An explosively insensitive ignitor for igniting propellant in a propellant chamber, comprising:
   - an insensitive explosive material;
   - a slapper type detonator for initiating by shock the insensitive explosive material;
   - means for containing and dispersing a shockwave resulting from detonation of the insensitive explosive material such that the propellant is retained in the propellant chamber while the shockwave passes through the containing and dispersing means; and,
   - means for controlling the release of hot gases and particles resulting from detonation of the insensitive explosive material and directing the hot gases and particles to the propellant such that the propellant is ignited after the shockwave has ceased.

2. An ignitor according to claim 1 wherein the gas and particle controlling means comprises an orifice between the insensitive explosive and the propellant.

3. An ignitor according to claim 2, further comprising a conical nozzle proximate the orifice flaring out to the propellant wherein the orifice is sufficiently small so that the shockwave is dispersed in a housing.

4. An insensitive ignitor according to claim 3, wherein the propellant is thermally ignited by the release of hot gases and particles.

5. An ignitor according to claim 1 wherein the dispersing means comprises a high strength steel housing encompassing the explosive material.

6. A method of igniting a propellant in a propellant chamber, comprising the steps of:

detonating by shock an explosively insensitive material with a slapper type high amperage current detonator;

providing a housing and collar surrounding the explosively insensitive material for confining the explosion and dispersing the shockwave resulting from the detonation of the insensitive material so that the propellant is retained in the propellant chamber while the shockwave passes through the collar and the housing; and regulating hot gases and particles resulting from the detonation and directing the hot gases and particles into the propellant after the shockwave passes to ignite the propellant.

7. A method according to claim 6, wherein the hot gases and particles are regulated by an orifice between the insensitive material and the propellant.

8. A method according to claim 7, wherein the gases and particles are dispersed through a conical nozzle to the propellant after passing through the orifice.

9. An explosively insensitive ignitor for igniting a propellant in a propellant chamber, comprising:

a pellet of an insensitive explosive material;

a slapper type detonator for detonating by shock the explosively insensitive pellet;

a housing for retaining the insensitive explosive material adjacent the propellant, the housing including a collar surrounding the explosively insensitive pellet, wherein the housing and collar contain and disperse a shockwave resulting from detonation of the insensitive material, the housing forming a conical nozzle between the insensitive explosive material and the propellant, and wherein the nozzle is sufficiently small so that the propellant is retained in the propellant chamber during the shockwave, and the nozzle restricts and directs flow of hot gases from detonation of the insensitive explosive material to ignite the propellant.

* * * * *